US009882261B2

(12) United States Patent
Blaney

(10) Patent No.: US 9,882,261 B2
(45) **Date of Patent: *Jan. 30, 2018**

(54) THREE-AXIS PEDESTAL HAVING MOTION PLATFORM AND PIGGY BACK ASSEMBLIES

(71) Applicant: Sea Tel, Inc., Concord, CA (US)

(72) Inventor: Peter Blaney, Walnut Creek, CA (US)

(73) Assignee: Sea Tel, Inc., Concord, CA (US)

( * ) Notice: Subject to any disclaimer, the term of this patent is extended or adjusted under 35 U.S.C. 154(b) by 54 days.

This patent is subject to a terminal disclaimer.

(21) Appl. No.: 14/638,390

(22) Filed: Mar. 4, 2015

(65) Prior Publication Data

US 2015/0236398 A1 Aug. 20, 2015

Related U.S. Application Data

(63) Continuation of application No. 13/168,457, filed on Jun. 24, 2011, now Pat. No. 9,000,995.
(Continued)

(51) Int. Cl.
*H01Q 3/00* (2006.01)
*H01Q 1/18* (2006.01)
(Continued)

(52) U.S. Cl.
CPC ..... *H01Q 1/185* (2013.01); *H01Q 1/34* (2013.01); *H01Q 3/08* (2013.01); *H01Q 25/00* (2013.01)

(58) Field of Classification Search
CPC H01Q 1/85; H01Q 1/185; H01Q 3/08; H01Q 1/34; H01Q 25/00
See application file for complete search history.

(56) References Cited

U.S. PATENT DOCUMENTS 3,514,608 A 5/1970 Whetter
5,419,521 A 5/1995 Matthews
(Continued)

FOREIGN PATENT DOCUMENTS

WO WO 2008/132141 A1 11/2008

OTHER PUBLICATIONS

Analog devices, High Accuracy, Dual-Axis Digital Inclinometer and Accelerometer, pp. 1-22.*
(Continued)

*Primary Examiner* — Dieu H Duong
(74) *Attorney, Agent, or Firm* — Morgan, Lewis & Bockius LLP

(57) ABSTRACT

A rotationally-stabilizing tracking antenna system includes a three-axis pedestal, a drive assembly rotating a vertical support assembly relative to a base assembly, a cross-level driver pivoting a cross-level frame assembly relative to the vertical support assembly, and an elevation driver pivoting an elevation frame assembly relative to the cross-level frame assembly, a motion platform assembly affixed to the elevation frame assembly, three orthogonally mounted angular rate sensors disposed on the motion platform assembly sensing motion about X, Y and Z axes, a three-axis gravity accelerometer mounted on the motion platform assembly to determine a true-gravity zero reference, and a control unit determining the actual position of elevation frame assembly based upon sensed motion about X, Y, and Z axes and the true-gravity zero reference, and controlling the azimuth, cross-level and elevation drivers to position the elevation frame assembly in a desired position.

12 Claims, 13 Drawing Sheets

Related U.S. Application Data

(60) Provisional application No. 61/452,639, filed on Mar. 14, 2011, provisional application No. 61/358,938, filed on Jun. 27, 2010.

(51) Int. Cl.

| | |
|---|---|
| ***H01Q 3/08*** | (2006.01) |
| ***H01Q 1/34*** | (2006.01) |
| ***H01Q 25/00*** | (2006.01) |

(56) References Cited

U.S. PATENT DOCUMENTS

| | | | | |
|---|---|---|---|---|
| 2007/0001920 | A1 | 1/2007 | Webb et al. | |
| 2008/0291101 | A1 | 11/2008 | Braunstein et al. | |
| 2008/0297427 | A1 | 12/2008 | Jung et al. | |
| 2009/0009416 | A1 | 1/2009 | Blalock | |
| 2009/0066323 | A1 | 3/2009 | Wolfe | |
| 2010/0149059 | A1 | 6/2010 | Patel | |
| 2010/0271274 | A1 | 10/2010 | Gibson et al. | |
| 2012/0166137 | A1* | 6/2012 | Grasser | G01C 15/00 702/150 |

OTHER PUBLICATIONS

Takao Murakoshi, *Antenna stabilizing control system using a strapdown 2-axis Azimuth/Elevation method*, Microsyst Technol (2005) 11:590-597, DOI 10.107/s00542-005-0559-8.

Blaney, Office Action, U.S. Appl. No. 13/168,457, dated Apr. 30, 2014, 9 pgs.

Blaney, Notice of Allowance, U.S. Appl. No. 13/168,457, dated Nov. 26, 2014, 5 pgs.

SeaTel Inc., Office Action, KR10-20137000934, dated Jul. 1, 2016, 13 pgs.

SeaTel Inc., Notice of Allowance, KR10-20137000934, dated Nov. 15, 2016, 3 pgs.

* cited by examiner

THREE-AXIS PEDESTAL HAVING MOTION PLATFORM AND PIGGY BACK ASSEMBLIES

CROSS-REFERENCE TO RELATED APPLICATIONS

This application is a Continuation of U.S. patent application Ser. No. 13/168,457 filed Jun. 24, 2011, which claims priority to U.S. Provisional Patent Application No. 61/452,639 filed on Mar. 14, 2011 and to U.S. Provisional Patent Application No. 61/358,938 filed on Jun. 27, 2010, the entire contents of which applications are incorporated herein for all purposes by this reference.

BACKGROUND OF THE INVENTION

Field of the Invention

This invention relates, in general, to pedestals for tracking antenna and more particularly to satellite tracking antenna pedestals used on ships and other mobile applications and methods for their use.

Description of Related Art

The invention is especially suitable for use aboard ship wherein an antenna is operated to track a transmitting station, such as a communications satellite, notwithstanding roll, pitch, yaw, and turn motions of a ship at sea.

Antennas used in shipboard satellite communication terminals typically are highly directive. For such antennas to operate effectively they must be pointed continuously and accurately in the direction toward the satellite.

When a ship changes its geographical position, or when the satellite changes its position in orbit, and when the ship rolls, pitches, yaws and turns, an antenna mounted on the ship will tend to become misdirected. In addition to these disturbances the antenna will be subjected to other environmental stresses such as vibrations caused by shipboard machinery and shocks caused by wave pounding. All of these effects must be compensated for so that the antenna pointing can be accurately directed and maintained in such direction.

For nearly two decades, Sea Tel, Inc. has manufactured antenna systems of the type described in U.S. Pat. No. 5,419,521 to Matthews. Such antenna systems have a three-axis pedestal and employ a fluidic tilt or fluidic level sensor mounted in a structure referred to as a "Level Platform" or "Level Cage" in order to provide an accurate and stable Horizontal reference for directing servo stabilized antenna products. For example, the '521 patent shows a level platform (45) and a fluidic tilt sensor (54) which are illustrated in FIGS. 3 and 7A, respectively.

The fluidic tilt sensor produces very stable tilt angle measurements with respect to earth's gravity vector, but only over a limited angular range of +/−30° to +/−40°. As an antenna system's pointing angle can change from 0° to 90°, however, such fluidic tilt sensors can not be mounted directly to the antenna. Instead, the fluidic tilt sensor must be mounted in a structure that is rotated opposite the antenna pointing angle so that the structure always remains in an attitude that is substantially level with respect to the local horizon and perpendicular to earth's gravity vector. For example, an as shown in FIG. 1, a fluidic tilt sensor may be mounted within level platform structure 20 that is rotated opposite the antenna pointing angle by a level platform drive motor 22 via a drive belt 23 or other suitable means.

In addition to the fluidic tilt sensor for the elevation axis, the level platform structure normally incorporates a second fluidic tilt sensor for the cross-level axis and three inertial-rotational rate sensors. While the level platform design works very well, the configuration of the level platform structure adds to the complexity and cost of the antenna system. Namely, as shown in FIG. 1, the level platform structure 20 itself, the bearings which rotatably support hold the structure, the drive motor 22, the drive belt 23 and associated pulleys and hardware to rotationally drive and support the structure adds significant complexity and costs to the overall antenna system. In addition, electrical harnesses 25 connecting the drive motor to the level platform structure essentially sits in an outdoor environment near radar equipment, and the harnesses must be braided with shielded cable further adding significant costs.

A low cost and stable gravity reference sensor having a minimum range of 0 to 90°, plus the expected Tangential Acceleration range of +/−30 to +/−45 degrees is desired.

It would therefore be useful to provide an improved pedestal and control assembly for a tracking antenna having improved means to provide a simplified level reference assembly to overcome the above and other disadvantages of known pedestals.

BRIEF SUMMARY OF THE INVENTION

One aspect of the present invention is directed to a rotationally-stabilizing tracking antenna system suitable for mounting on a moving structure. The antenna system includes a three-axis pedestal for supporting an antenna about a first azimuth axis, a second cross-level axis, and a third elevation axis, a three-axis drive assembly for rotating a vertical support assembly relative to a base assembly about the first azimuth axis, a cross-level driver for pivoting a cross-level frame assembly relative to the vertical support assembly about the second cross-level axis, and an elevation driver for pivoting an elevation frame assembly relative to the cross-level frame assembly about the third elevation axis, a motion platform assembly affixed to and movable with the elevation frame assembly, three orthogonally mounted angular rate sensors disposed on the motion platform assembly for sensing motion about predetermined X, Y and Z axis of the elevation frame assembly, a three-axis gravity accelerometer mounted on the motion platform assembly and configured to determine a true-gravity zero reference, and a control unit for determining the actual position of elevation frame assembly based upon the sensed motion about said predetermined X, Y, and Z axes and said true-gravity zero reference, and for controlling the azimuth, cross-level and elevation drivers to position the elevation frame assembly in a desired position.

The antenna system of claim 1, wherein the predetermined X, Y, and Z axes may be orthogonal to one another. The three-axis gravity accelerometer may include a first two-axis gravity accelerometer mounted on the motion platform assembly and a second gravity accelerometer mounted on the motion platform assembly, the second gravity accelerometer mounted orthogonally to the first gravity accelerometer. The second gravity accelerometer may be a two-axis gravity accelerometer mounted orthogonally to the first gravity accelerometer.

The antenna system may include a three-axis pedestal for supporting an antenna about a first azimuth axis, a second cross-level axis, and a third elevation axis, a three-axis drive assembly for rotating a vertical support assembly relative to a base assembly about the first azimuth axis, a cross-level driver for pivoting a cross-level frame assembly relative to the vertical support assembly about the second cross-level axis, and an elevation driver for pivoting an elevation frame assembly relative to the cross-level frame assembly about the third elevation axis, a motion platform assembly including an enclosure affixed to and movable with the elevation frame assembly, a motion platform subassembly within the enclosure, three orthogonally mounted angular rate sensors disposed on the motion platform subassembly assembly for sensing motion about predetermined X, Y and Z axis of the elevation frame assembly, and a three-axis gravity accelerometer mounted on the motion platform subassembly and configured to determine a true-gravity zero reference, and a control unit for determining the actual position of elevation frame assembly based upon the sensed motion about said predetermined X, Y, and Z axes and said true-gravity zero reference, and for controlling the azimuth, cross-level and elevation drivers to position the elevation frame assembly in a desired position.

The predetermined X, Y, and Z axes may be orthogonal to one another. The three-axis gravity accelerometer may include a first two-axis gravity accelerometer mounted on the motion platform subassembly and a second gravity accelerometer mounted on the motion platform sub assembly, the second gravity accelerometer mounted orthogonally to the first gravity accelerometer. The second gravity accelerometer may be a two-axis gravity accelerometer mounted orthogonally to the first gravity accelerometer.

The antenna system may include a three-axis pedestal for supporting an antenna about three axes, the pedestal including a base assembly dimensioned and configured for mounting to the moving structure, a vertical support assembly rotationally mounted on the base assembly about a first azimuth axis, a cross-level frame assembly pivotally mounted on the vertical support assembly about a second cross-level axis, and an elevation frame assembly supporting the tracking antenna and pivotally mounted on the cross-level frame assembly about a third elevation axis, a three-axis drive assembly including an azimuth driver for rotating the vertical support assembly relative to the base assembly, a cross-level driver for pivoting the cross-level frame assembly relative to the vertical support assembly, and an elevation driver for pivoting the elevation frame assembly relative to the cross-level frame assembly, a motion platform assembly including an enclosure affixed to and movable with the elevation frame assembly, three orthogonally mounted angular rate sensors disposed within the enclosure for sensing motion about predetermined X, Y and Z axis of the elevation frame assembly, a first two-axis gravity accelerometer mounted within the enclosure, and a second gravity accelerometer mounted within the enclosure orthogonally to the first gravity accelerometer, wherein the first and second gravity accelerometers are configured to determine a true-gravity zero reference, and a control unit for determining the actual position of elevation frame assembly based upon the sensed motion about said predetermined X, Y, and Z axes and said true-gravity zero reference and controlling the azimuth, cross-level and elevation drivers to position the elevation frame assembly in a desired position.

The predetermined X, Y, and Z axes may be orthogonal to one another. The elevation frame assembly may have a rotational range of at least 90°. The first and second gravity accelerometers may be accurate to within 1° regardless of the angle of the elevation frame assembly. At least one of the first and second gravity accelerometer may be microelectromechanical system (MEMS) accelerometer. At least one of the first and second gravity accelerometers operably connected to the control unit with a non-braided wire harness. At least one of the first and second gravity accelerometers may have a maximum error of 1° within an operating temperature range of −40° C. to +125° C. The second gravity accelerometer may be a two-axis gravity accelerometer mounted orthogonally to the first gravity accelerometer.

The antenna system may include a three-axis pedestal for supporting an antenna about three axes, the pedestal including a base assembly dimensioned and configured for mounting to the moving structure, a vertical support assembly rotatably mounted on the base assembly about a first azimuth axis, a cross-level frame assembly pivotally mounted on the vertical support assembly about a second cross-level axis, and an elevation frame assembly supporting the tracking antenna and pivotally mounted on the cross-level frame assembly about a third elevation axis, a three-axis drive assembly including an azimuth driver for rotating the vertical support assembly relative to the base assembly, a cross-level driver for pivoting the cross-level frame assembly relative to the vertical support assembly, and an elevation driver for pivoting the elevation frame assembly relative to the cross-level frame assembly, a motion platform assembly including an enclosure affixed to and movable with the elevation frame assembly, three orthogonally mounted angular rate sensors disposed within the enclosure for sensing motion about predetermined X, Y and Z axis of the elevation frame assembly, a first two-axis gravity accelerometer mounted on a motion platform subassembly within the enclosure, and a second gravity accelerometer mounted on the motion platform subassembly orthogonally to the first gravity accelerometer, wherein the first and second gravity accelerometers are configured to determine a true-gravity zero reference, and a control unit for determining the actual position of elevation frame assembly based upon the sensed motion about said predetermined X, Y, and Z axes and said true-gravity zero reference and controlling the azimuth, cross-level and elevation drivers to position the elevation frame assembly in a desired position.

The antenna system may include predetermined X, Y, and Z axes may be orthogonal to one another. The antenna system may include elevation frame assembly may have a rotational range of at least 90°. The antenna system may include first and second gravity accelerometers may be accurate to within 1° regardless of the angle of the elevation frame assembly. At least one of the first and second gravity accelerometer may be microelectromechanical system (MEMS) accelerometer. At least one of the first and second gravity accelerometers operably connected to the control unit with a non-braided wire harness. At least one of the first and second gravity accelerometers may have a maximum error of 1° within an operating temperature range of −40° C. to +125° C. The antenna system may include second gravity accelerometer may be a two-axis gravity accelerometer mounted orthogonally to the first gravity accelerometer.

Another aspect of the present invention is directed to a rotationally-stabilizing tracking antenna system suitable for mounting on a moving structure. The antenna system may include a three-axis pedestal including a first azimuth axis, a second cross-level axis, and a third elevation axis, a three-axis drive assembly for rotating a vertical support assembly relative to a base assembly about the first azimuth axis, a cross-level driver for pivoting a cross-level frame assembly relative to the vertical support assembly about the second cross-level axis, and an elevation driver for pivoting an elevation frame assembly relative to the cross-level frame assembly about the third elevation axis, a primary antenna affixed relative to the cross-level frame assembly, a secondary antenna affixed relative to the cross-level frame assembly, and a control unit for selecting operation of a selected one of the primary and secondary antennas, determining the actual position of elevation frame assembly based upon the sensed motion about said predetermined X, Y, and Z axes, and for controlling the azimuth, cross-level and elevation drivers to position the selected one of the primary and secondary antennas in a desired position for tracking a communications satellite.

The secondary antenna may have a cant of approximately 70-85° relative to the primary antenna. The secondary antenna may have a cant of approximately 105-120° relative to the primary antenna.

The primary antenna is an offset antenna. The primary antenna has a look angle that is approximately 5-20° below the horizontal when the cross-level frame is positioned at 0° relative to the horizontal.

One of the primary and secondary may include a feed assembly including a remotely adjustable polarizer. The remotely adjustable polarizer may include a tubular-body that is rotated by an electric motor disposed on the feed assembly. Both of the primary and secondary antennas may be operably connected to the control unit via a single coax cable.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In its simplest form the present invention includes supporting structural members, bearings, and drive means for positioning various rotating and pivoting structural members which are configured to align a tracking antenna about three axis, an azimuth axis, a cross-level axis, and an elevation axis. Antenna stabilization is achieved by activating drive means for each respective axis responsive to external stabilizing control signals. In some aspects, the pedestal of the present invention is similar to that disclosed by U.S. Pat. No. 5,419,521 to Matthews, U.S. Patent Application Publication No. 2010/0149059 to Patel, the entire content of which patent and publication is incorporated herein for all purposes by this reference, as well as those used in the Sea Tel® 4009, Sea Tel® 5009 and Sea Tel® 6009, and other satellite communications antennas sold by Sea Tel, Inc. of Concord, Calif.

Generally, when a ship is not in motion, for example, when it is in port, antenna pointing in train and elevation coordinates is relatively simple. But when underway, the ship rolls and/or pitches thus causing the antenna to point in an undesired direction. As such, corrections of the train and elevation pointing angles of the antenna are required. Each of the new pointing commands requires solution of a three-dimensional vector problem involving angles of ship's heading, roll, pitch, yaw, train, and elevation.

A pedestal in accordance with the present invention provides support means for tilt sensors, accelerometers, angular rate sensors, Earth's magnetic field sensors, and other instruments useful for generating pedestal stabilizing control signals.

Figure 2:
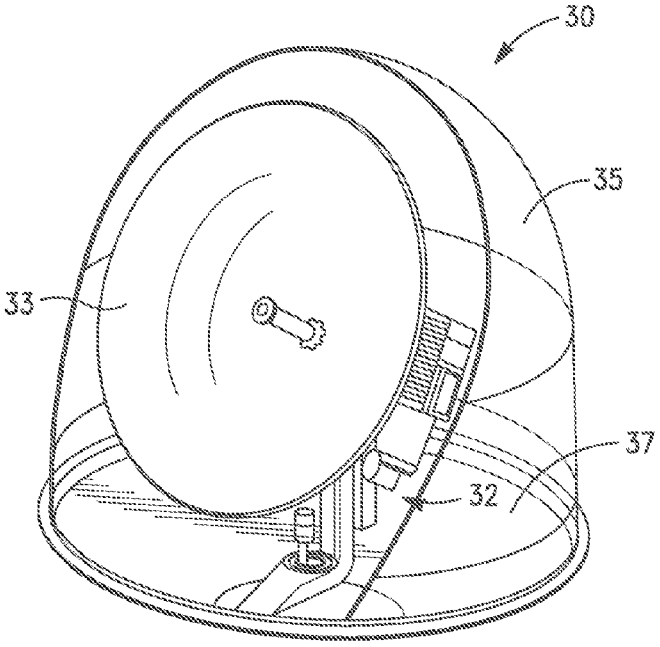
FIG. 2 is a perspective view of an exemplary tracking antenna having a three-axis pedestal with motion platform assembly in accordance with the present invention

Turning now to the drawings, wherein like components are designated by like reference numerals throughout the various figures, attention is directed to FIG. 2 which shows an exemplary satellite communications antenna system 30 in accordance with the present invention generally including a three-axis pedestal 32 supporting an antenna 33 within a protective radome 35 (shown cutaway and transparent to facilitate viewing) and a radome base 37. The antenna system is adapted to be mounted on a mast or other suitable portion of a vessel having a satellite communication terminal. The terminal contains communications equipment and otherwise conventional equipment for commanding the antenna to point toward the satellite in elevation and azimuth coordinates. Operating on the pedestal in addition to those antenna pointing commands is a servo-type stabilization control system which is integrated with the pedestal.

Figure 3:
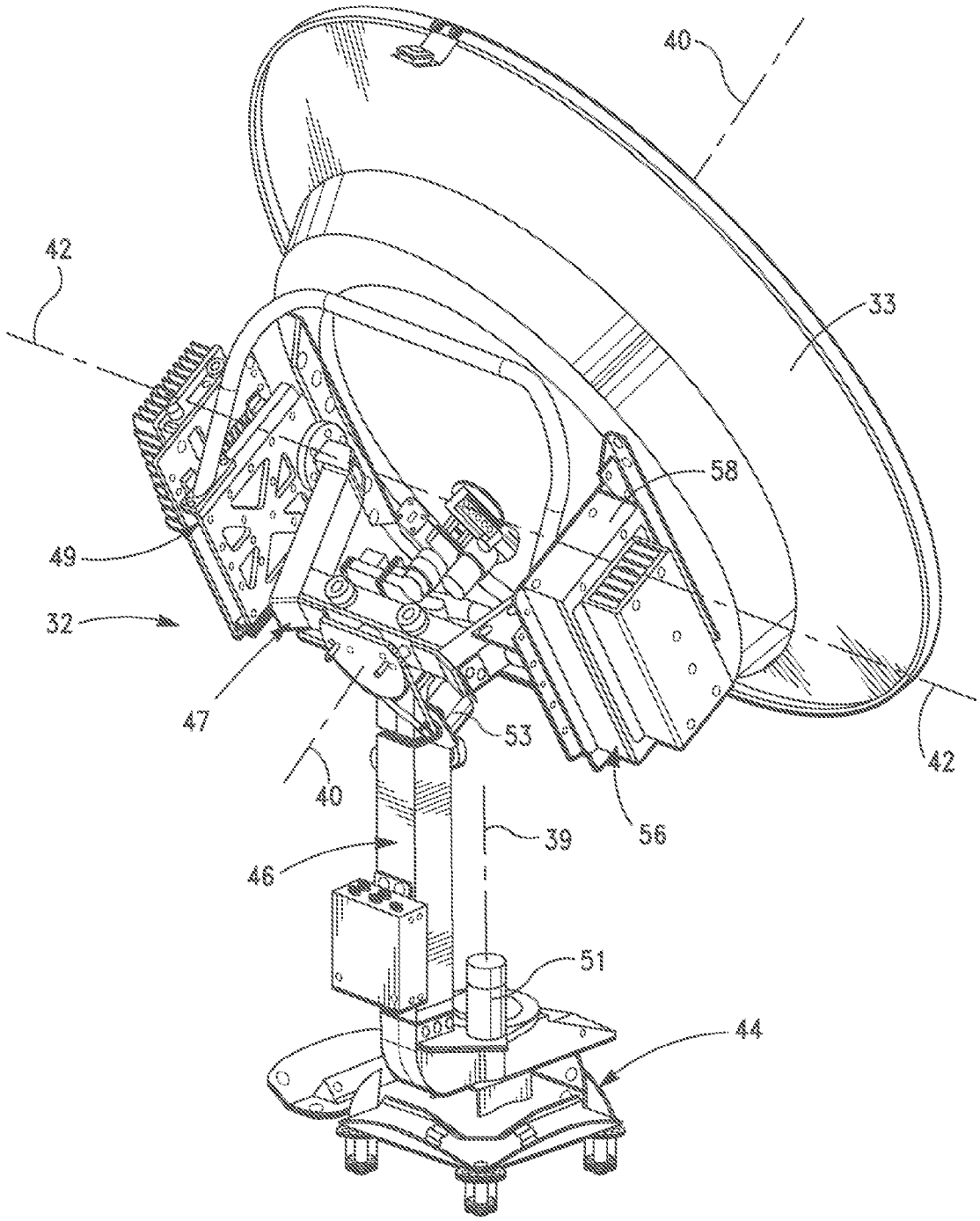
FIG. 3 is a right isometric view of the tracking antenna of FIG. 2 without the radome and radome base.
Figure 4:
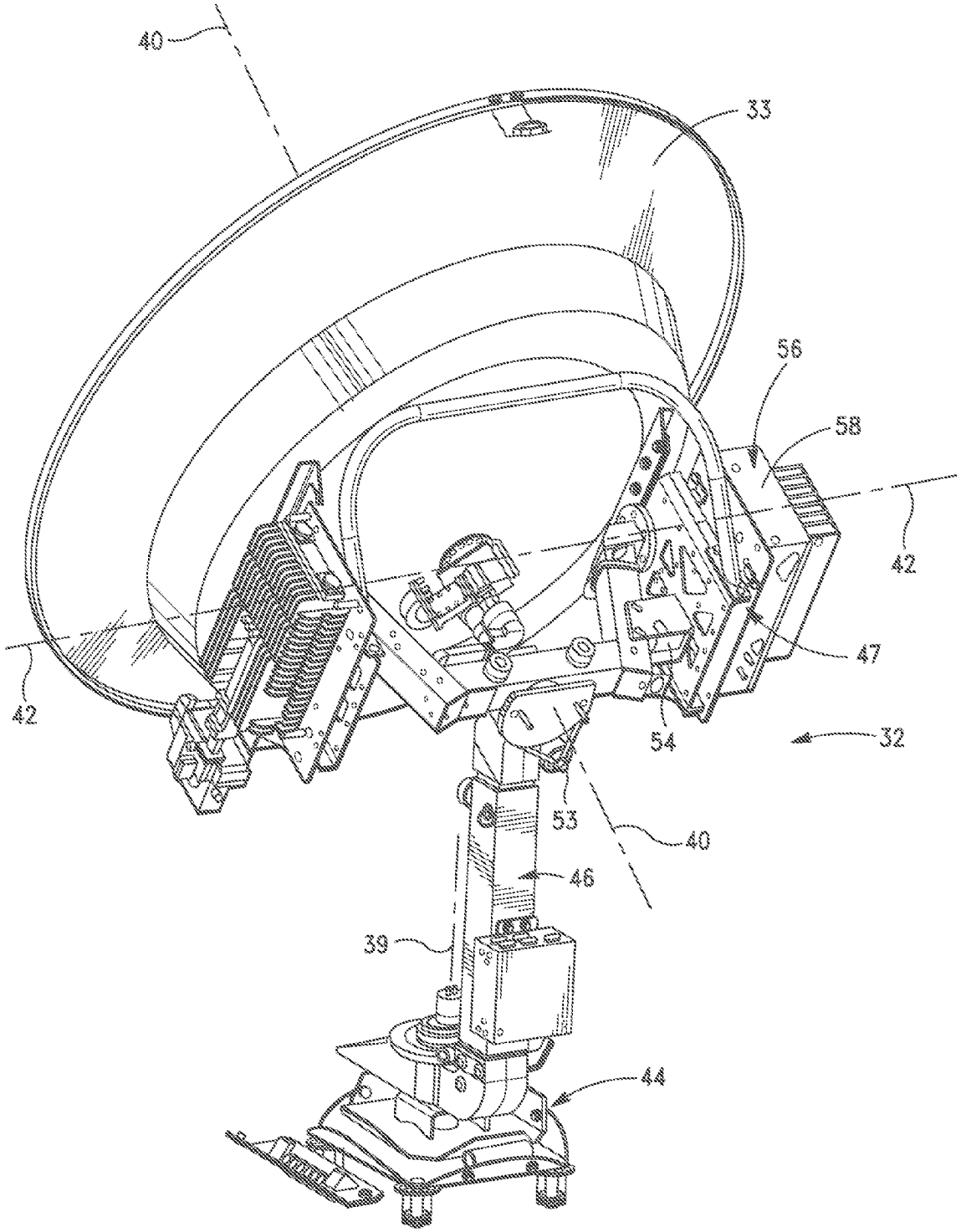
FIG. 4 is a left isometric view of the tracking antenna of FIG. 2 without the radome and radome base.

With reference to FIG. 3, the servo-control system utilizes sensors, electronic signal processors and motor controllers to automatically align the antenna about an azimuth axis 39, a cross-level axis 40, and an elevation axis 42 to appropriate elevation and azimuth angles for accurate tracking of a satellite or other communications device.

The pedestal generally includes a base assembly 44, a vertical support assembly 46 rotationally supported on the base assembly about azimuth axis 39. Preferably the vertical support assembly may rotate 360° with respect to the base assembly. A cross-level frame assembly (or level frame assembly) 47 is supported by the vertical support assembly such that the antenna may pivot about cross-level axis 40. Preferably the cross-level frame assembly may pivot at least +/−20 to 30° relative to the vertical support assembly. And an elevation frame assembly 49 is supported by the cross-level frame assembly such that antenna 33 may pivot about elevation axis 42 in an otherwise conventional manner. Preferably, the elevation frame assembly may pivot at least 90°, and more preferably at least 120° (e.g., 90° pointing+ 2×roll range) relative to the cross-level frame assembly.

A three-axis drive assembly is provided that includes an azimuth driver 51 for rotating the vertical support assembly relative to the base assembly, a cross-level driver 53 for pivoting the cross-level frame assembly relative to the vertical support assembly, and an elevation driver 54 for pivoting the elevation frame assembly relative to the cross-level frame assembly. One will appreciate that each of the drivers may be an electric motor or other suitable drive means configured to impart rotational or pivotal motion upon their respective components in an otherwise conventional manner. One should also appreciate that the order of the three axes may be changed without affecting the scope of this invention. For example the order may be azimuth, elevation and then cross level. The end result will be the same pointing angle.

Motion Platform

In contrast to prior systems, tracking antenna system 30 includes a motion platform assembly 56 including an enclosure 58 affixed to and movable with the elevation frame assembly 49.

Figure 5:
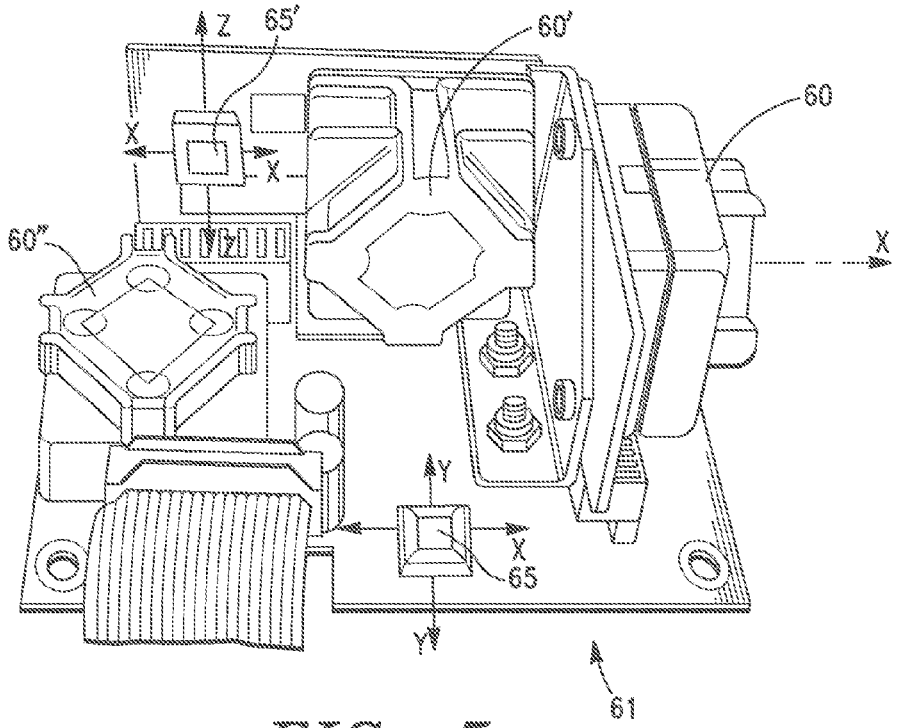
FIG. 5 is an enlarged perspective view of a motion platform subassembly of the tracking antenna of FIG. 2.

With reference to FIG. 5, the motion platform assembly includes three orthogonally mounted angular rate sensors 60, 60' and 60" disposed within the enclosure for sensing motion about orthogonal X, Y and Z axis of the elevation frame assembly. In the illustrated embodiment, the sensors are CRS03 angular sensors provided by Silicon Sensing Systems Limited of Hyogo, Japan. One will appreciate, however, that other suitable sensors may be utilized.

Figure 6:
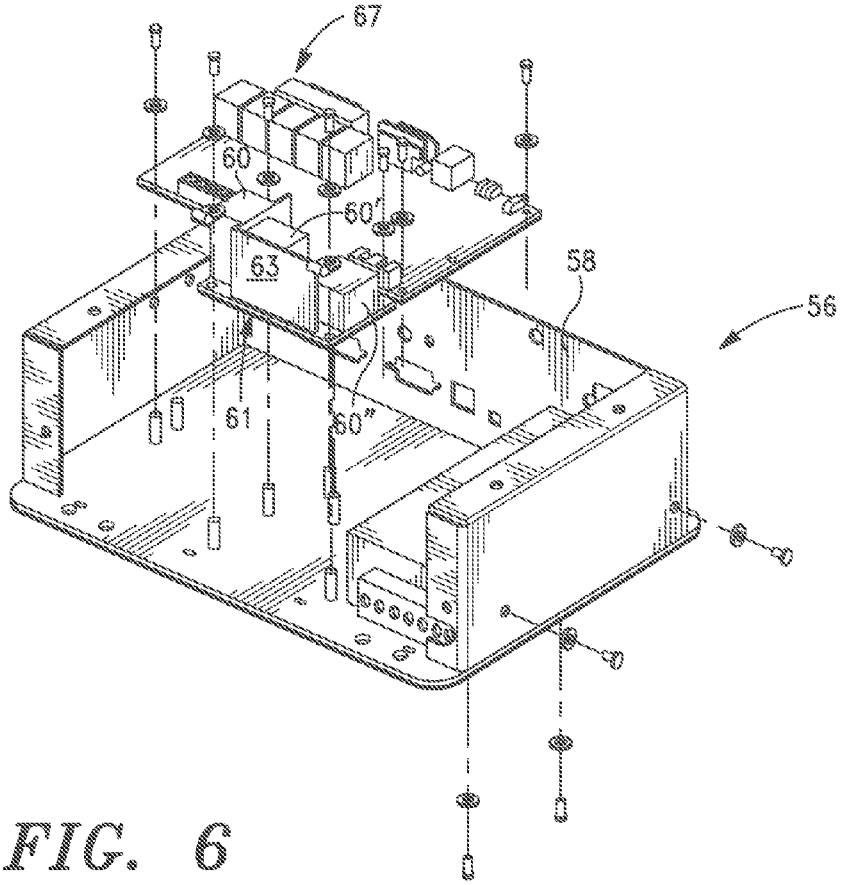
FIG. 6 is an isometric view of the motion platform subassembly being installed within a Pedestal Control Unit (PCU) of the tracking antenna of FIG. 2.
Figure 7:
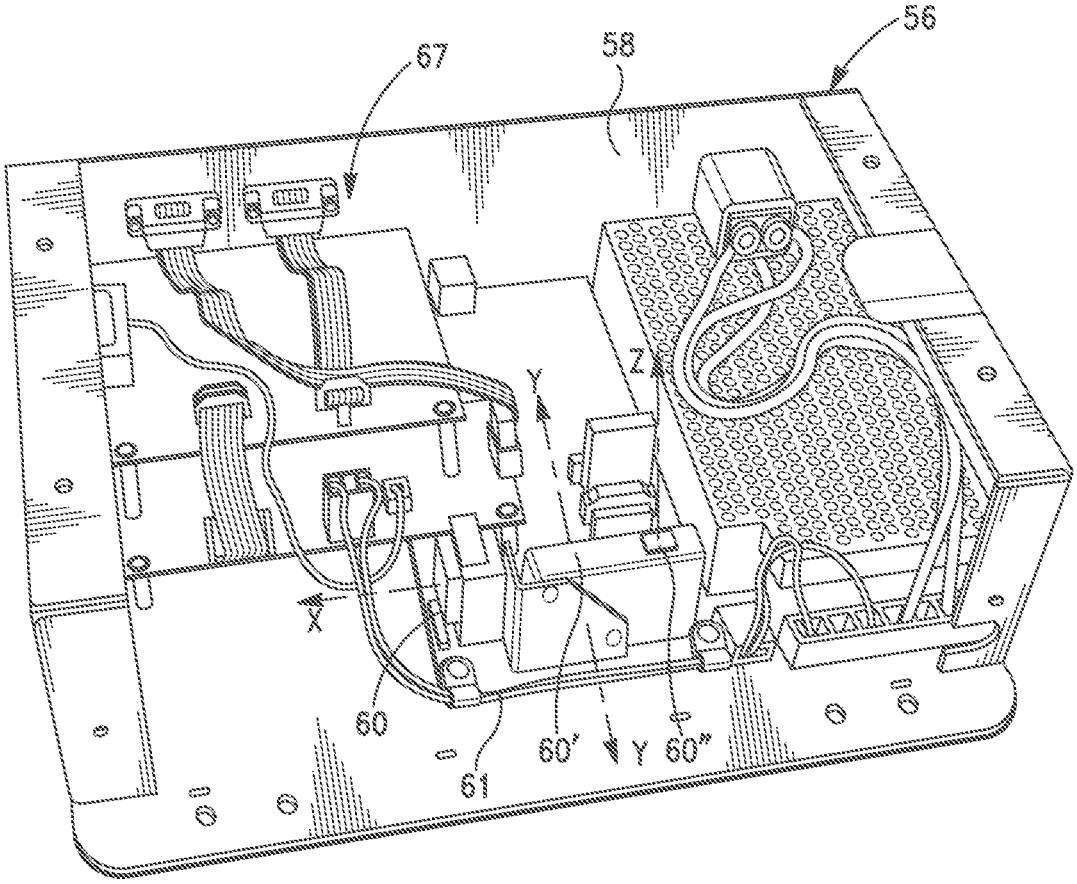
FIG. 7 is an enlarged perspective view of the motion platform subassembly mounted within the PCU of the tracking antenna of FIG. 2.

In various embodiments, the rate sensors are disposed in close proximity with one another on a motion platform subassembly 61. As shown in FIG. 5, the motion platform subassembly may take the form of orthogonally disposed circuit boards orthogonally secured to one another by an assembly bracket 63. Such an arrangement facilitates fabrication and assembly as it allows the sensors circuitry to be preassembled and simultaneously installed within the closure, as shown in FIG. 6. One will appreciate, however, that the sensors may also be indirectly mounted to the motion platform subassembly or elsewhere within the enclosure.

With continued reference to FIG. 5, a three-axis gravity accelerometer is also mounted on motion platform subassembly 61 within enclosure 58. The three-axis gravity accelerometer is in the form of first and second gravity accelerometers 65, 65' are also mounted on motion platform subassembly 61 within enclosure 58. In the illustrated embodiment, the gravity accelerometers are ADIS16209 accelerometers provided by Analog Devices of Norwood, Mass. One will appreciate, however, that other micro-electro-mechanical system (MEMS) accelerometer and/or other suitable accelerometers may be utilized, preferably ones that meet various desired operational parameters discussed in further detail below.

Figure 10:
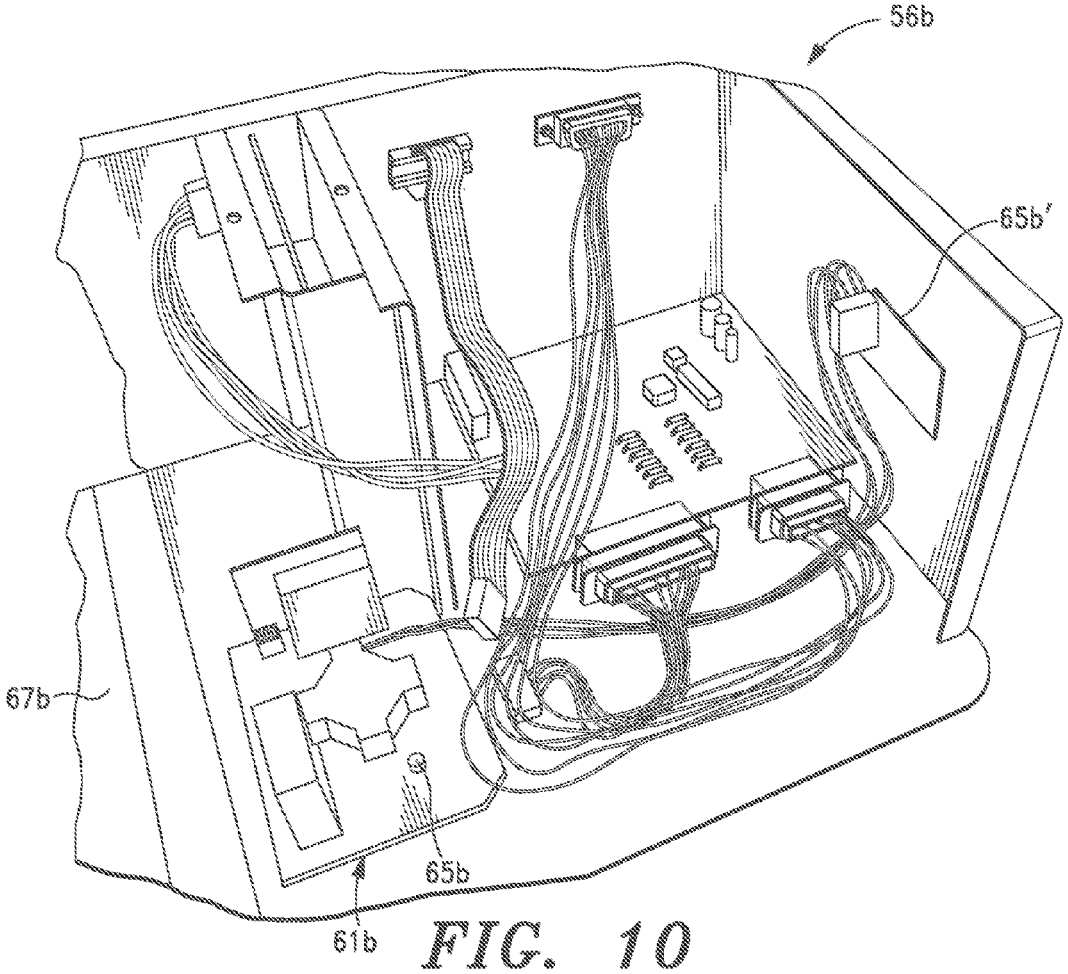
FIG. 10 is an enlarged perspective view of the motion platform mounted within the PCU of the tracking antenna of FIG. 9.

In various embodiments, one dual axis gravity accelerometer 65 is mounted on a base circuit board while the second dual axis gravity accelerometer 65' is mounted on a rear wall circuit board, however one will appreciate that the second gravity accelerometer may be instead mounted on the illustrated side wall circuit board. Mounting the gravity accelerometers directly to circuit board facilitates assembly and reduces the number of electrical connections needed, however, one will appreciate that the gravity accelerometers may also be indirectly mounted to the motion platform subassembly. Moreover, mounting the gravity accelerometers on the motion platform assembly within the Control Unit enclosure obviates the need for a braided and shielded wiring harness because the gravity accelerometers are operably connected to the control circuitry within the enclosure and without exposure to the harsh outdoor environment. To this end, one will appreciate that the gravity accelerometers may be located elsewhere within the motion platform assembly or the Control Unit enclosure. For example, as shown in FIG. 10, one gravity accelerometer **65*b* may be located on motion platform subassembly 61*b* while another gravity accelerometer 65*b*' may be mounted on a wall of enclosure 58*b***.

In the illustrated embodiment, both gravity accelerometers 65, 65' are two-axis accelerometers, the first being disposed along X and Y axes, and the second being disposed along X and Z axis. While such configuration creates some redundancy, it may lead to manufacturing efficiencies in that it reduces the number of unique parts required to keep in inventory. Nonetheless, one accelerometer may be replaced with a single-axis device, provided that the single axis is arranged orthogonal to both axis of the other two-axis device (e.g., the two-axis accelerometer arranged along the X and Y axis while the single-axis accelerometer is arranged along the Z axis). Moreover, the accelerometers may be replaced with three single-axis devices, provided that each axis is arranged mutually orthogonal to the other single-axis devices (e.g., the two-axis accelerometer arranged along the X and Y axis while the single-axis accelerometer is arranged along the Z axis).

Two-axis gravity accelerometers are particularly well suited for use in the present invention as they may be rotated completely around and provide acceptable accuracy. For example, the two-axis ADIS16209 accelerometers used with the present invention are accurate to within 1° regardless of the angle of the elevation frame assembly, and more preferably less than 0.1°.

Moreover, the ADIS16209 accelerometers are particularly well suited as they have a maximum error less than 1° within an operating temperature range, and presently within approximately of 0.2° within an operating temperature range of −40° C. to +125° C. The accelerometers incorporate a microprocessor, calibration capabilities, temperature sensing capabilities, temperature correction capabilities, and other processing capabilities. Accordingly, such accelerometers are particularly well suited for use of ocean-going vessels operating in a wide range of climates and temperatures, anywhere from the equator to the North Sea and beyond.

The tracking antenna system of the present invention further includes a pedestal control unit (PCU) 67 for determining the actual position of elevation frame assembly based upon signals output from the angular rate sensors 60, 60' and 60" and the gravity accelerometers 65, 65'.

Figure 1:
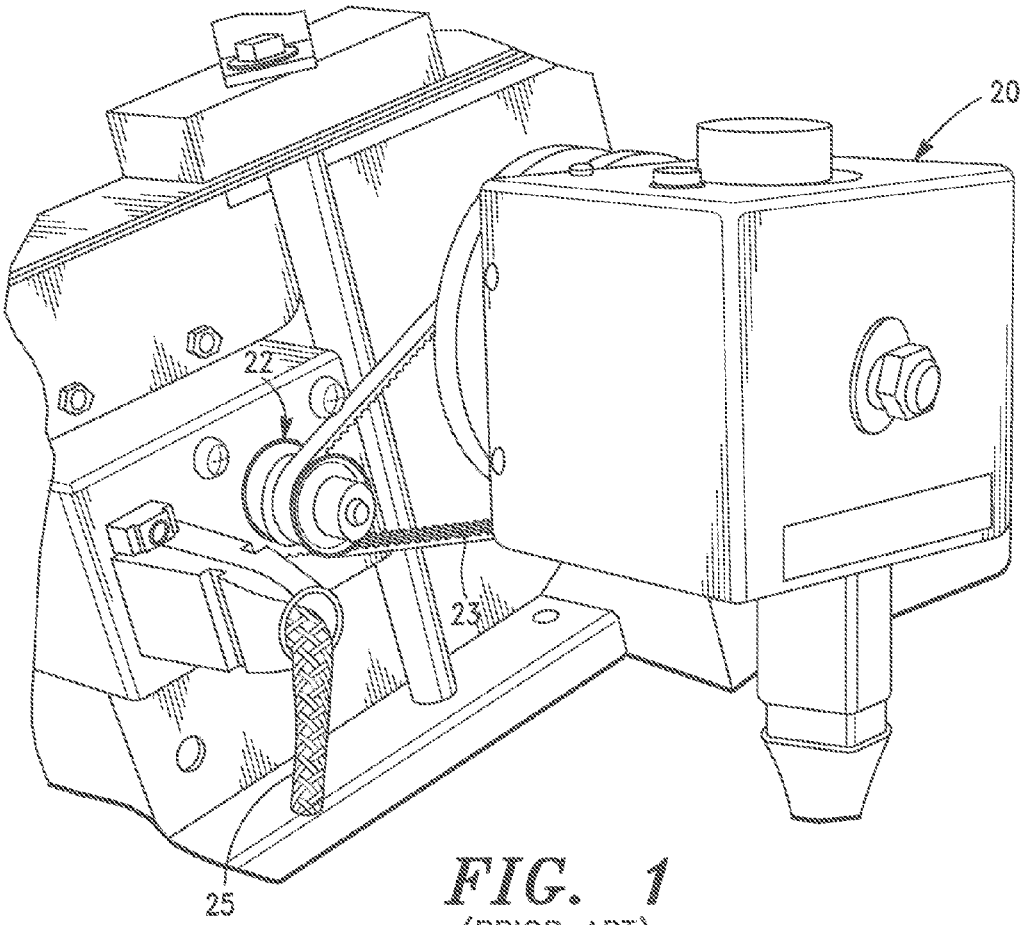
FIG. 1 (PRIOR ART)
FIG. 1 is a perspective view of a known level platform of a three-axis pedestal of the type described in U.S. Pat. No. 5,419,521 to Matthews.

In contrast to prior devices in which gyroscopic rate sensors were mounted in a level platform structure (e.g., level platform structure 20 in FIG. 1), the gyroscopic rate sensors were always kept substantially aligned with the three stabilized axes, namely longitudinal, lateral and vertical axes. Such prior designs allowed for very simple control loops: a cross level sensor exclusively drove the cross level axis; an elevation sensor drove elevation axis; and an azimuth sensor drove the azimuth axis.

In the motion platform configuration of the present invention, angular rate sensors 60, 60' and 60" move with antenna 33 and elevation frame assembly 49 as the antenna rotates between 0° and 90°, and thus the sensors change their relationship with respect to the elevation, cross level and azimuth axes. Thus the angular sensors sense motion about orthogonal X, Y and Z axes fixed with respect to the elevation frame assembly.

To correct for this, gravity accelerometers 65, 65' sense a true-gravity zero reference (i.e., the earth's gravity vector). In particular, the gravity accelerometers sense gravitational acceleration along the X, Y and Z axes and, utilizing analytic geometry, control unit 67 determines the true-gravity zero reference. Armed with the zero reference, the control unit can determine the actual location of the X, Y and Z axes relative to the zero reference, and using otherwise conventional coordinate rotation mathematics, for example, rotational transformation matrices, to determine the desired position of the X, Y and Z axis and control azimuth, cross-level and elevation drivers 51, 53 and 54, respectively, to position the elevation frame assembly in a desired position.

While it is preferred that the gravity accelerometer(s) are arranged along orthogonal X, Y and Z axis, one will appreciate that the accelerometers may be placed in other known orientations to one another. For example, if one or more axis is non-orthogonal to the others, provided that at least three axes are non-parallel to one another, and their orientations are known with respect to one another, the control unit can be modified to account for the alternate orientations of the axes, for example, by modifying the rotational transformation matrices to account for the oblique angle(s).

Tracking antenna systems in accordance with various aspects of the present invention to provide an improved maritime satellite tracking antenna pedestal apparatus which provides accurate pointing, is reliable in operation, is easily maintained, uncomplicated, and economical to fabricate.

Figure 8:
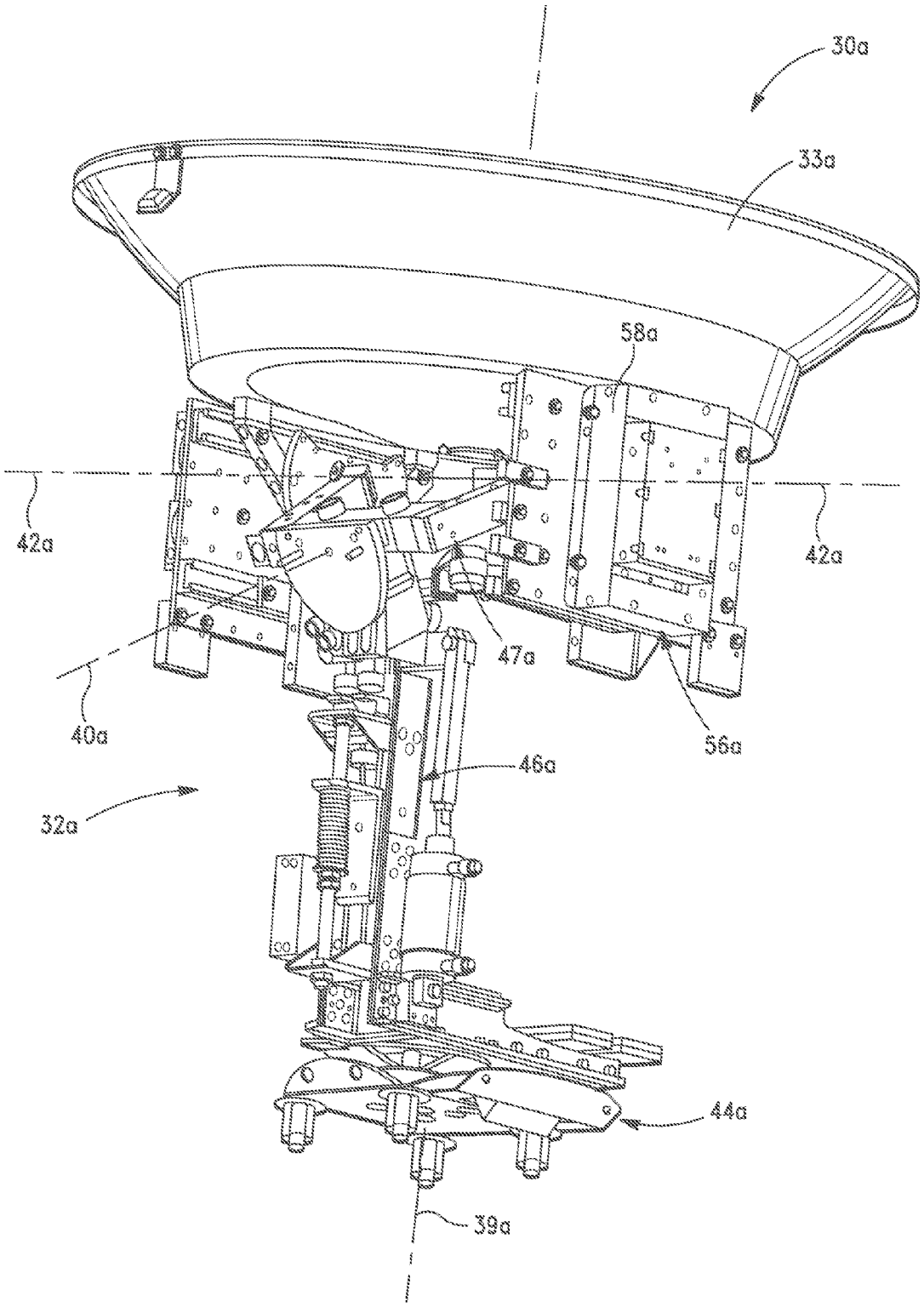
FIG. 8 is an isometric view of another exemplary tracking antenna similar to that shown in FIG. 2.
Figure 9:
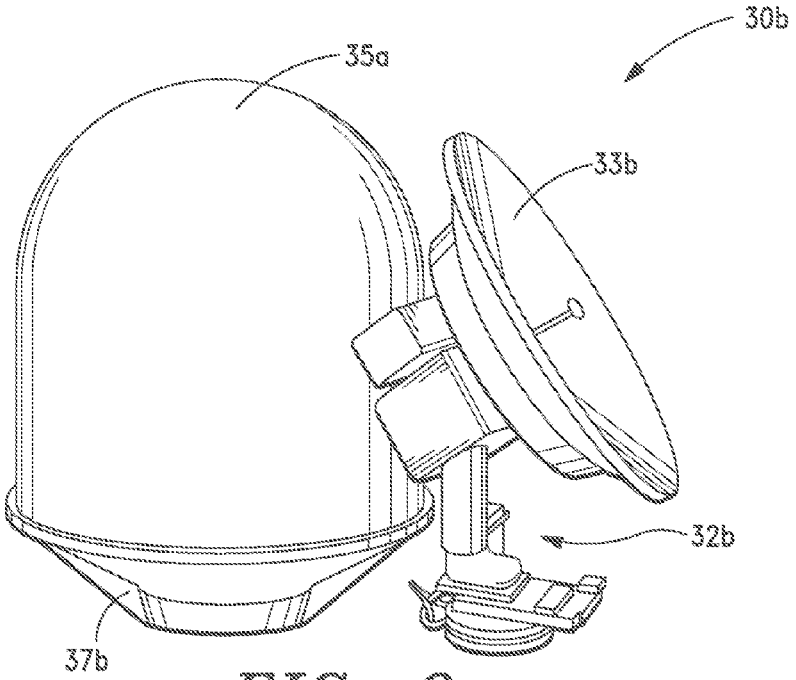
FIG. 9 is a perspective view of another exemplary tracking antenna similar to that shown in FIG. 2.

In other exemplary embodiments of the present invention, tracking antenna systems 30*a* and 30*b* are similar to tracking antenna system 30 described above but includes different pedestals 32*a* and 32*b* as shown in FIG. 8 and FIG. 9, respectively. In particular, motion platform assemblies 56*a* and 56*b* are affixed to elevation frame assemblies 49*a* and 49*b*, and thus move with antenna 33*a* and 33*b*, respectively. Like reference numerals have been used to describe like components of these systems. In operation and use, tracking antenna systems 30*a* and 30*b* are used in substantially the same manner as tracking antenna system 30 discussed above.

Piggy Back

In various embodiments of the present invention, the antenna assembly may be provided with multiple antennas on a single three-axes pedestal for providing additional functionality within a specified footprint. For the purposes of the present invention, "piggyback" refers to such a dual-antenna/single pedestal configuration, along with all other usual denotations and connotations of the term.

Figure 11:
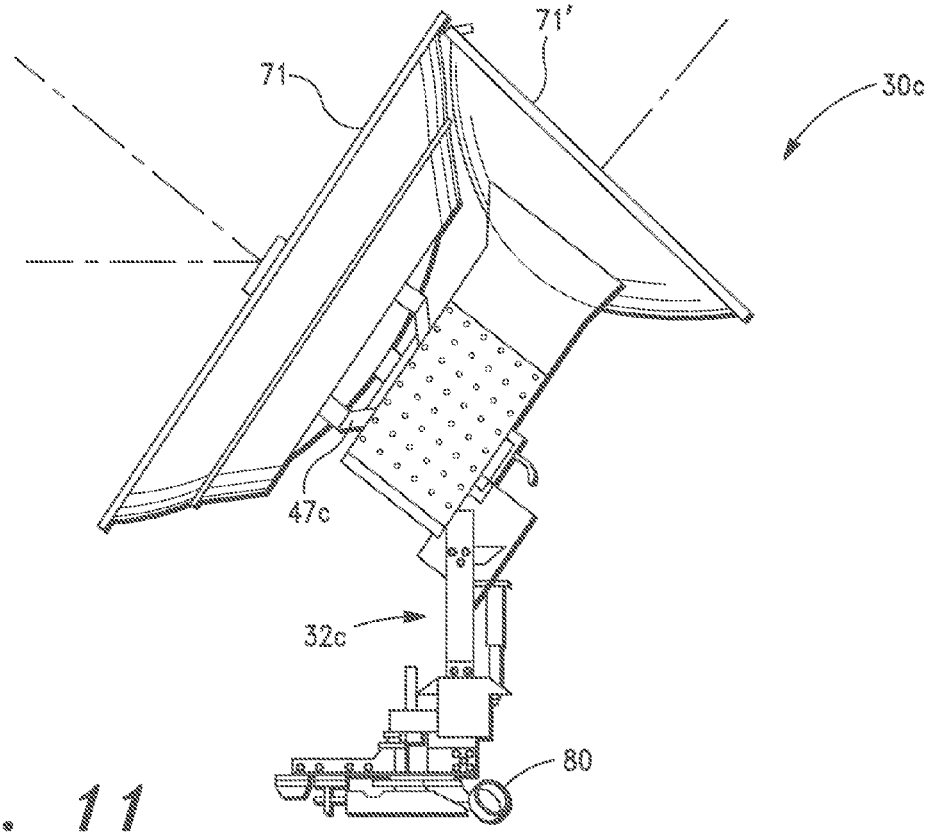
FIG. 11 is an elevational view of another exemplary tracking antenna similar to that shown in FIG. 2 having a piggy back configuration.

With reference to FIG. 11, antenna assembly 30*c* has a three-axes pedestal 32*c* that is, in many aspects, similar to that of the Sea Tel® 6009 3-Axis marine stabilized antenna system but having a secondary antenna 33*c'* mounted on the same pedestal. In the illustrated embodiment, the primary antenna has a primary reflector 71 that is compatible with C-band satellites, while the secondary antenna has a reflector 71' that is compatible with Ku-band satellites. One will appreciate that various configurations may be utilized. The primary antenna may be compatible with one or more bands including, but not limited to, C-band, X-band, Ku-band, K-band, and Ka-band, while the secondary antenna is compatible with one or more other bands. In various embodiments, the larger primary antenna is preferably compatible with C-band transmissions, and the smaller secondary antenna is preferably compatible with Ku-band or Ka-band transmissions.

Figure 12:
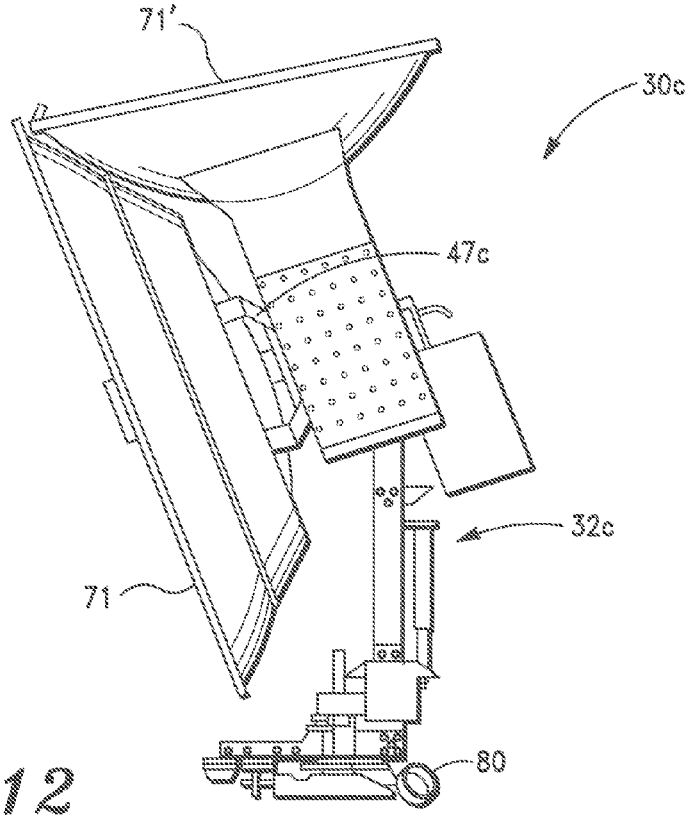
FIG. 12 is an elevational view of the tracking antenna of FIG. 11 showing the antennas positioned at a first extent of motion.
Figure 13:
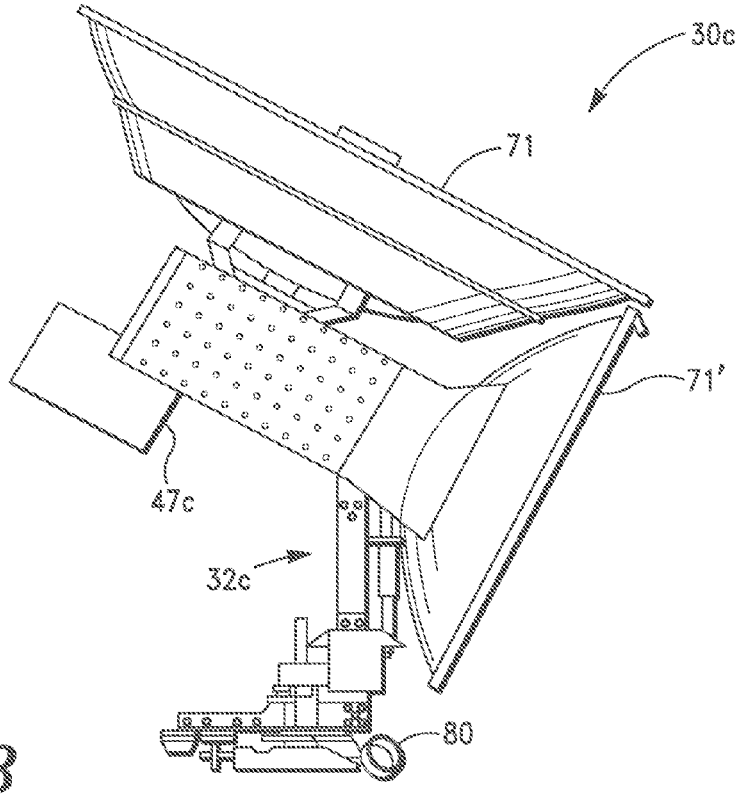
FIG. 13 is an elevational view of the tracking antenna of FIG. 11 showing the antennas positioned at a second extent of motion.

As shown in FIG. 11, FIG. 12, and FIG. 13, secondary antenna 33*c'* is mounted for movement along with primary antenna 33*c*. In particular, reflector 71' of the secondary antenna is affixed relative to reflector 71 of the primary antenna. In the illustrated embodiment, the secondary reflector is mounted on cross-level frame assembly 47*c* along with the primary reflector but offset approximately 90°

In FIG. 11, primary reflector is shown at 45° with respect to the horizontal, while the secondary reflector is shown at 135°. In FIG. 12, the primary reflector is shown at its lower extent of −15°, while the secondary is at 75°. And in FIG. 13, the primary is shown at its higher elevational extent 115°, while the primary is shown at 205°. In the illustrated embodiment, the working elevational range of the primary antenna is approximately −15° to 115° (25° past zenith) which accommodates ship motions of up to +/−20° roll and +/−10° pitch, assuming preferred communications with satellites are from approximately 5° above the horizon to zenith. This allows for a working elevational range of the secondary antenna of approximately −30 to +100°. One will appreciate, however, that the actual range of motion may vary.

Figure 14:
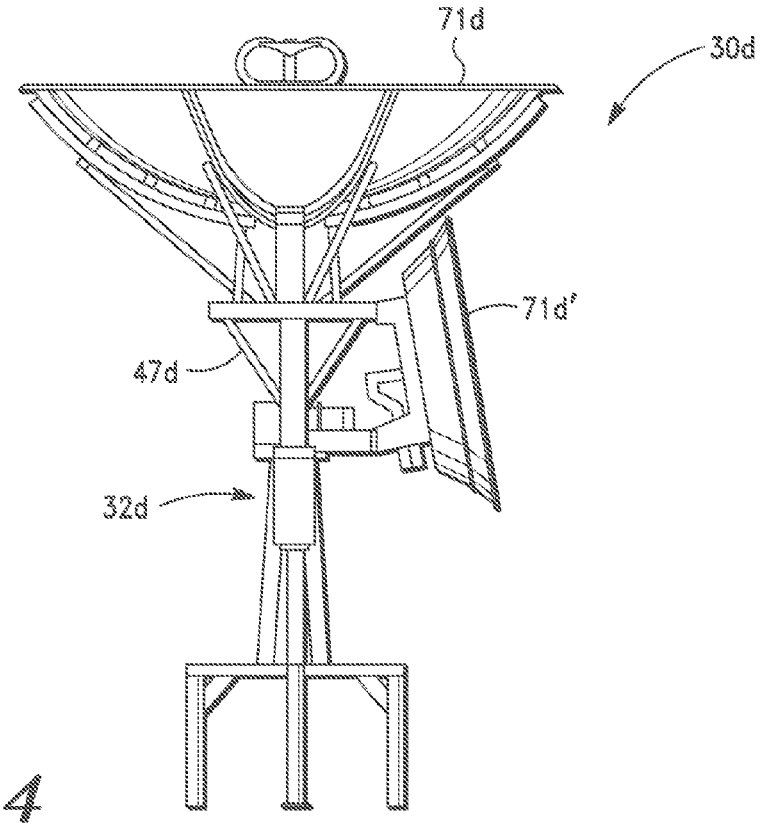
FIG. 14 is an elevational view of another exemplary tracking antenna similar to that shown in FIG. 11 having a piggy back configuration.
Figure 15:
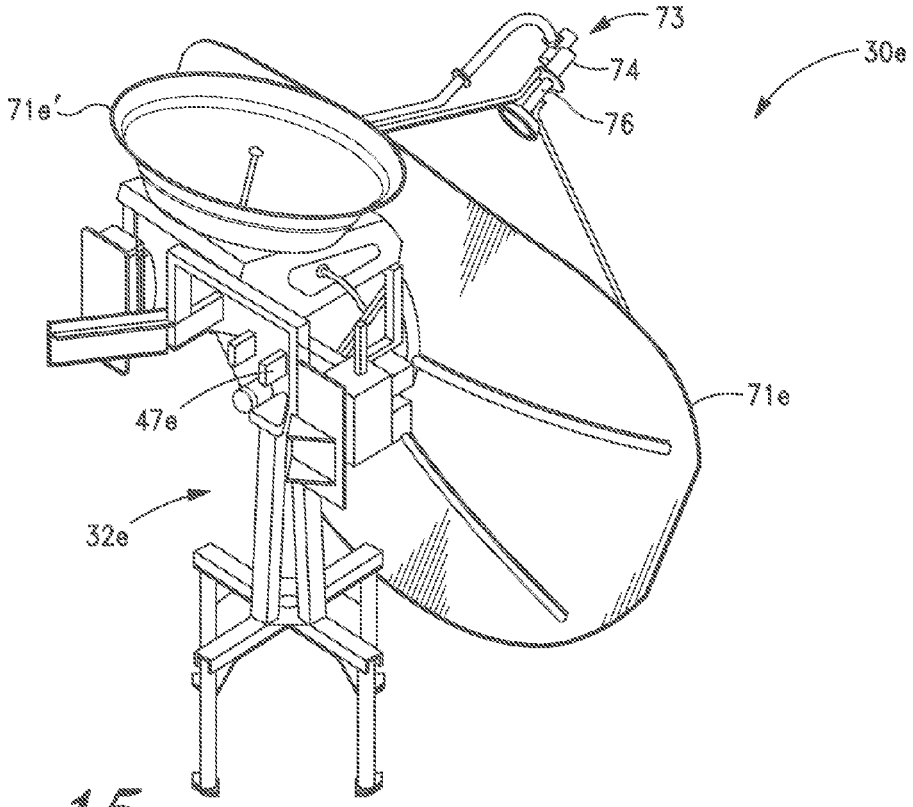
FIG. 15 is an isometric view of another exemplary tracking antenna similar to that shown in FIG. 11 having a piggy back configuration.

The above-described piggyback antenna assembly is particularly well suited for VSAT communications. One will appreciate that piggyback antenna assemblies are well suited for other applications such as Tx/Rx, TVRO (TV-receive-only), INTELSAT (International Telecommunications Satellite Organization) and DSCS (Defense Satellite Communications System). For example, the antenna assembly shown in FIG. 14 is particularly well suited for TVRO applications, while the antenna assembly shown in FIG. 15 is particularly well suited for applications that are INTELSAT and DSCS compliant applications.

Figure 16:
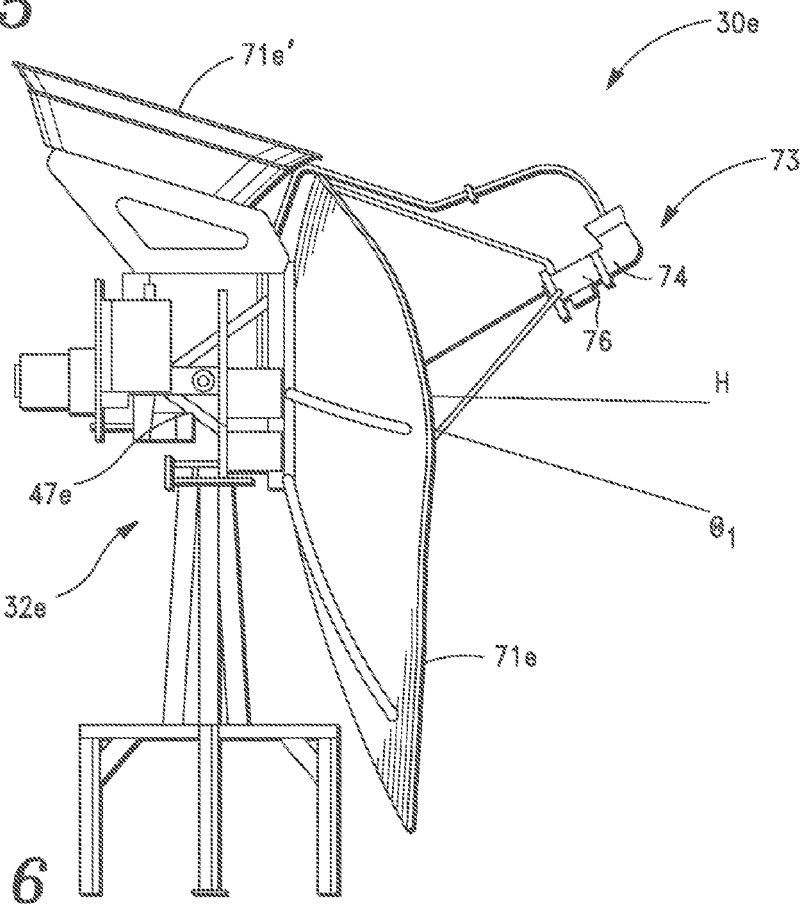
FIG. 16 is an elevational view of the exemplary tracking antenna of FIG. 15.

Turning now to FIG. 16, one will appreciate that the primary and secondary antennas need not be precisely orthogonal to one another, and may instead be oriented at various angles with respect to one another. In the illustrated embodiment, primary antenna 33*e* and elevation frame assembly 49*e* is approximately level with the horizontal. The primary antenna, however, is an offset antenna in which the "look" angle $\theta_L$ is approximately −17°, that is, approximately 17° below horizon H. In this case, the secondary antenna is approximately 197° beyond zenith. In this embodiment, the primary and antenna are positioned approximately 87-88° relative to one another. However, one will appreciate that the cant of the secondary antenna relative to the primary antenna may vary, for example, 90° or more, or 80° or less. Preferably, the cant is in the range of approximately 70-120°, more preferably in the range of approximately 85-105°.

In various embodiments, such as shown in FIG. 11 the smaller secondary antenna is canted more than 90° relative to the primary antenna order to provide sufficient clearance to stay within the radome. The actual amount of cant may vary depending upon the overall configuration of the antenna assembly, with a primarily purpose being the use of otherwise unused space for a secondary antenna located behind the primary antenna.

Preferably, the piggyback antenna assembly is remotely switchable. To this end, the assembly may be provided with hardware and software that is configured to remotely and readily switch bands and/or polarizations.

For example, the antenna assembly may not only include otherwise-known capabilities for switching between dual bands on one reflector, but may also, or instead, include capabilities for switching between different bands on different reflectors. For example, in the embodiment illustrated in FIG. 11, the antenna assembly may be configured to switch between C-band and X-band on the large primary reflector 71, and be figured to switch between the band(s) of the primary reflector and the Ku-band on the small secondary reflector.

Figure 17:
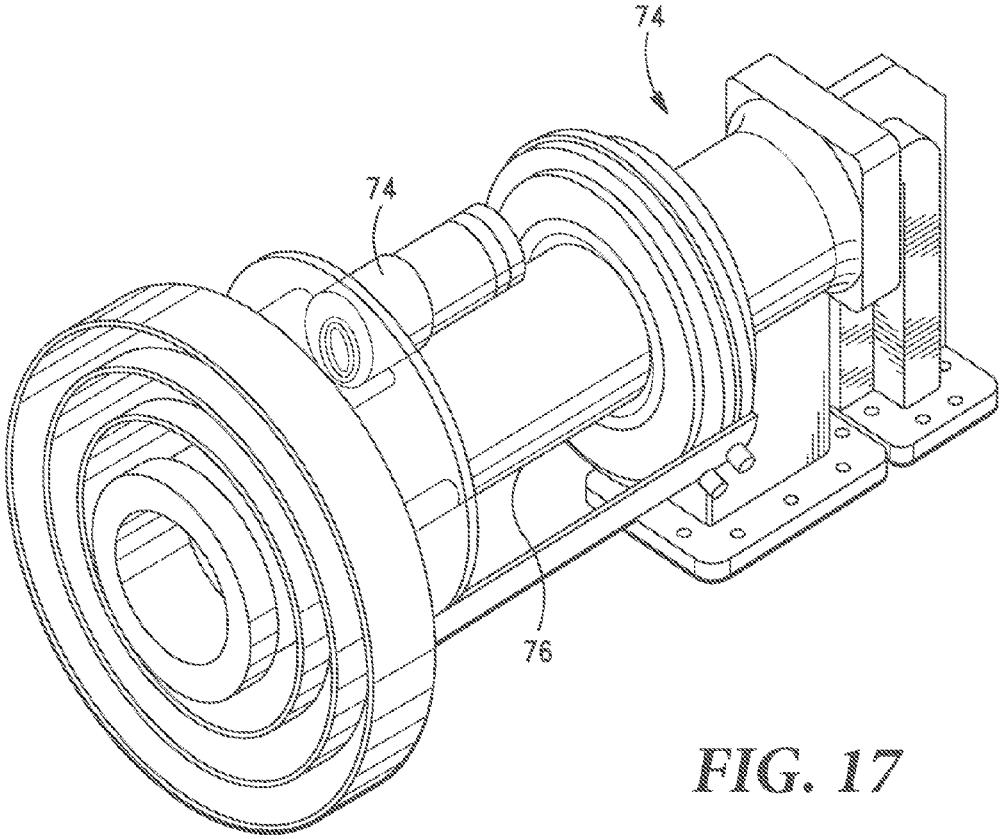
FIG. 17 is an enlarged isometric view of an exemplary OMT assembly of the exemplary tracking antenna of FIG. 15.
Figure 18:
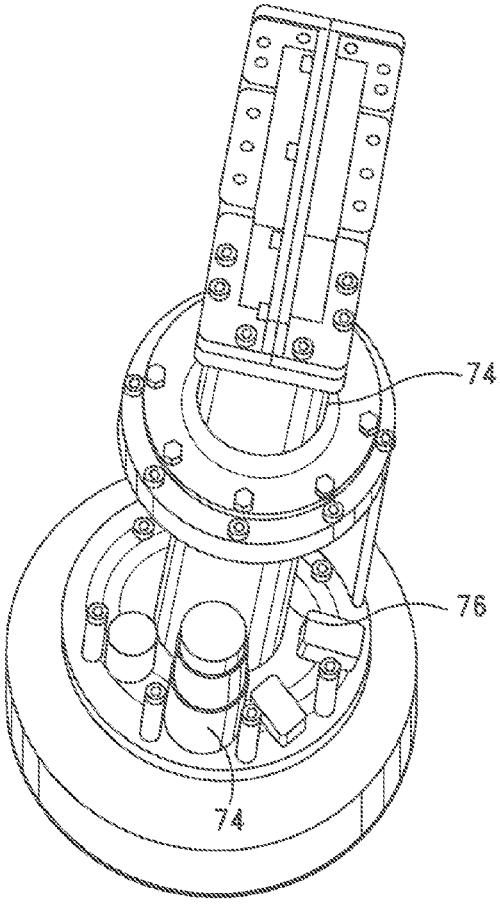
FIG. 18 is another enlarged isometric view of the exemplary OMT assembly of the OMT of FIG. 17.
Figure 19:
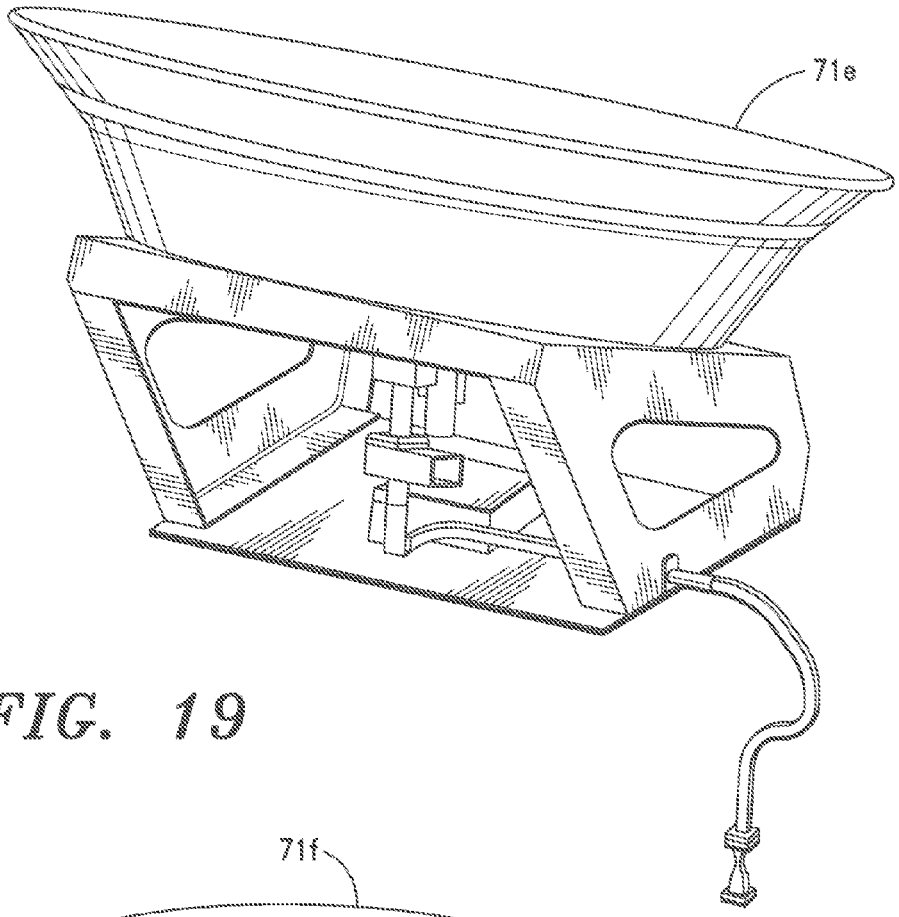
FIG. 19 is an enlarged isometric view of an exemplary secondary antenna assembly of the exemplary tracking antenna of FIG. 15.
Figure 20:
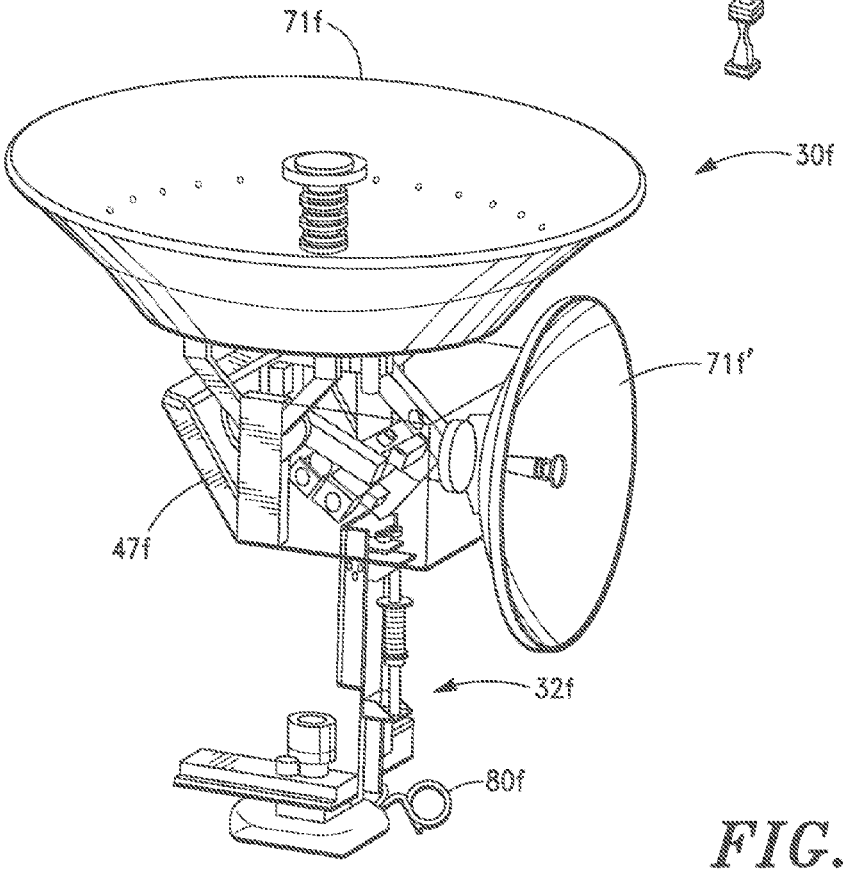
FIG. 20 is an elevational view of another exemplary tracking antenna similar to that shown in FIG. 11 having a piggy back configuration.
Figure 21:
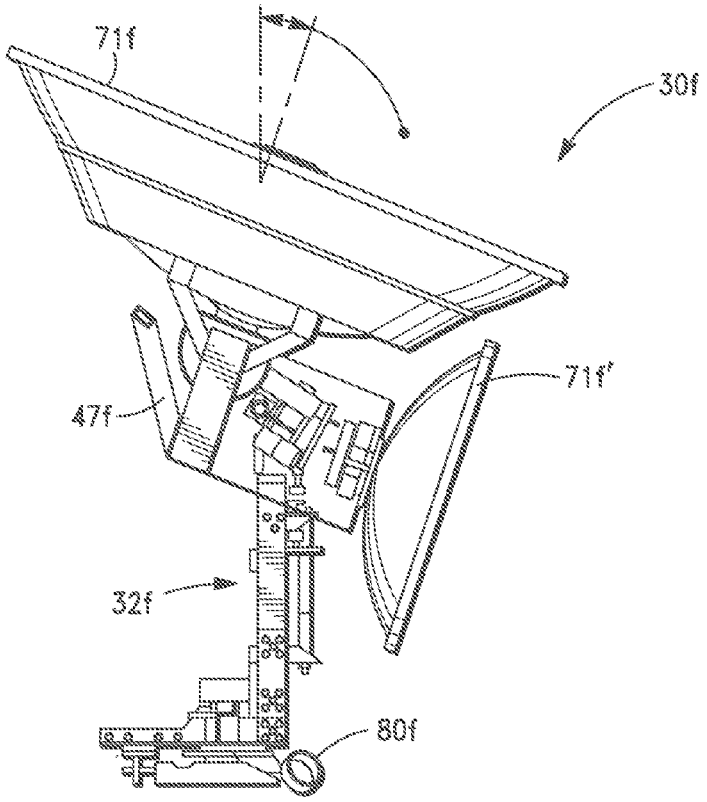
FIG. 21 is an elevational view of the exemplary tracking antenna of FIG. 20 positioned at a second extent of motion.
Figure 22:
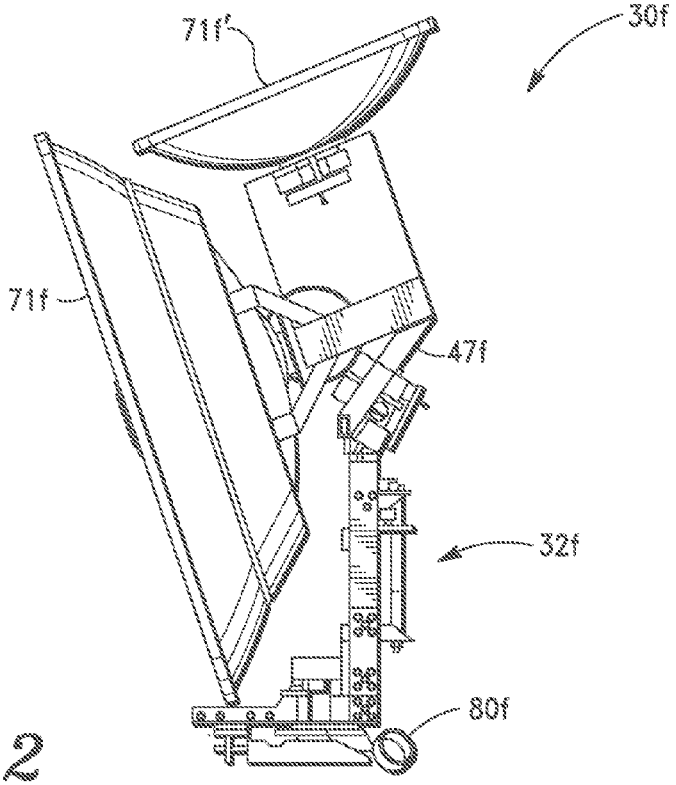
FIG. 22 is an elevational view of the exemplary tracking antenna of FIG. 20 positioned at a second extent of motion.

The antenna assembly may also provide for an electronically switchable to accommodate for circular and linear polarizations on the same reflector without having to manually change the feed. For example, FIG. 17 and FIG. 18 depict a remotely adjustable polarization feed 73, in which a motor 74 drives a polarizer 76 to vary the signal received by orthomode transducer (OMT) 78. In the illustrated embodiment, the polarizer is generally a length of tube inside of which is a quarter-wave plate or quarter-wavelength plate. The quarter-wavelength plate changes a linearly polarized signal to a circular polarized signal before it is received by the OMT. Rotating the polarizer tube to 45° counterclockwise (ccw) or 45° clockwise (cw) determines whether horizontal or vertical components of the signal wave get converted into right hand or left hand.

In accordance with the present invention, motor 74 is remotely operable to rotate polarizer tube 76 and the quarter plate therein. Such remote operation avoids the present necessity of climbing up to the antenna assembly, accessing the assembly with the radome, disassembly of the feed and polarizer tube, rotating the polarizer, reassembly, etc. The remote control of the present invention reduces the conventional couple-hour job of manual adjustment of the polarizer to a process that may be accomplished within minutes, or less Preferably, the hardware and software of the present antenna assemblies are configured to reduce the cabling from multiple antennas. Generally, a coaxial cable is necessary for each antenna. However, the present invention allows for reducing the number of coax cables to a single coax cable 80 by frequency shifting the transmit, receive, Ethernet control channel and 10 MHz TX reference clock all onto a single coax cable.

The control unit may be provided with relay board switches to control two sets of control signals from the control unit to the primary and secondary antennas. For example, a bank of relays may be configured for designed switching between conventional 25 pin connectors and 10 pin connectors in order to selectively route communications between the control unit and the desired one of the primary and secondary antennas.

In accordance with the present invention, when multiple antennas are used in a piggy-back configuration, control unit 67 is integrated with various programming and algorithms to accomplish the search, track, targeting and stabilization. A primary purpose of the piggy back antenna pedestal is to communicate via two separate reflectors on the same pedestal. Typically, these reflectors would be tuned and equipped with different transmit and receive equipment for different radio frequency segments.

For example, one C-band radio frequency reflector and one Ku-band radio frequency reflector. Since Ku-band requires a much smaller reflector, it is possible to use the empty space in the radome enclosure on the backside of the C-band reflector to mount the Ku reflector. In doing so, the same mechanical equipment can be used to point both reflectors. However, the control system for accurately pointing each reflect toward its desired target must be adjusted.

One difference between the traditional pointing control system and the dual antenna system of the present invention is to know which antenna is currently being used to communicate and how driving the pedestal in one direction or another will influence the point angle of the operating reflector.

In the case described above the C and Ku reflectors have different pointing angles. For example, and as discussed above, a three-axis pedestal generally moves about an azimuth axis 39, an elevation axis 42, and a cross-level axis 40. When a pedestal is equipped with multiple reflectors, there are various implications to be considered. A clockwise increase in azimuth (i.e., rotation about the azimuth axis) is a clockwise increase on both reflectors. However, since the reflectors are generally pointing toward opposing horizons, an increase in elevation (i.e., rotation about elevation axis) on the primary reflector (e.g., 71, 71*d*, 71*e*) is a decrease in pointing elevation on the secondary reflector (e.g., 71', 71*d*', 71*e*'), and vice versa. Also, a clockwise increase in cross level (i.e., rotation about the cross level axis) on the primary reflector is a counter-clockwise motion on the secondary reflector. accordingly, movement in azimuth is offset by 180°, movement in elevation is inverted, and movement in cross level is reversed.

In accordance with the present invention, the software of the control unit is specifically configured to compensate for various other factors, such as trim for mechanical alignments, polarity angle offset, scale and type, tracking, and system type.

In various embodiments, the control system is configured with azimuth trim and elevation trim to help compensate for mechanical variations from pedestal to pedestal. One will appreciate that, due to various manufacturing processes and despite manufacturing tolerances, there will be certain dimensional variances from pedestal to pedestal. In addition, various reflectors configured for different bands will have varying structure and dimensions. Accordingly, the control system may be provided with adjustable trim settings to compensate for such variations.

In various embodiments, the control system accommodates for Polang (Polarity Angle) Offset, Scale and Type. Polang Offset is similar to the azimuth and elevation trims above and works to align the feed Polarity Angle for each antenna to a nominal offset. Polang Scale will vary the amount of motor drive which is used to move the feed. Polang Type will also change from antenna to antenna as this parameter is used to store information about the motor and feedback used.

In various embodiments, the control system accommodates for varying tracking processes including dish scan and step size. These parameters are used to increase or decrease the corresponding amount of movement when while the antenna is tracking a satellite, that is, attempting to find the strongest pointing angle which can be used to receive and transmit signals. These values usually change dependant on the size of reflector and frequency spectrum which is currently being tracked. When a smaller secondary antenna is used to receive a different frequency spectrum, this parameter will have to change.

In various embodiments, the control system accommodates system types. This parameter is used to store several different settings which may change when a different antenna is used to transmit and/or receive signal. One example is modem lock and blockage signal polarity. If two separate modems are used for the two separate antennas, the polarity of the modems may be different from antenna to antenna. The same logic can be used for signaling a blockage for the modem. Another example is external modem lock. This may be used to indicate that an external source is receiving the correct signal. Since separate modems may be used for each antenna, this may also change from antenna to antenna. One more example is LNB (low noise block-downconverter) voltage. Since the two antennas will likely utilize two different LNBs, there may be two different methods of using those LNBs.

Accordingly, control system 67 will be provided with one or more stored sets of parameters which account for the variations between the primary and secondary and antennas. These stored sets of parameters may be in the form of lookup tables or other suitable stored information.

In many respects various modified features of the various figures resemble those of preceding features and the same reference numerals followed by subscripts "a", "b", "c", "d", and "e" designate corresponding parts.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents. It is also intended that the terms "comprising", "including", and "having" are open terminology, allowing the inclusion of other components in addition to those recited.

What is claimed is:

1. An antenna system comprising:

an antenna;

a vertical support assembly, a cross-level frame assembly, and an elevation frame assembly configured to movably support the antenna;

an azimuth driver for rotating the vertical support assembly-about an azimuth axis;

a cross-level driver for pivoting the cross-level frame assembly relative to the vertical support assembly about-a cross-level axis;

an elevation driver for pivoting the elevation frame assembly relative to the cross-level frame assembly about an elevation axis;

a motion platform assembly affixed to and movable with the elevation frame assembly, wherein the motion platform assembly includes, mounted within an enclosure:

a first angular rate sensor configured to sense motion about a first axis, a second angular rate sensor configured to sense motion about a second axis that is orthogonal to the first axis, a third angular rate sensor configured to sense motion about a third axis that is orthogonal to the first axis and the second axis, and one or more accelerometers, wherein the one or more accelerometers are configured to determine a vector of Earth's gravity; and a control unit that is communicatively connected to the first angular rate sensor, the second angular rate sensor, the third angular rate sensor, and the one or more accelerometers, wherein the control unit is configured to determine a location relative to the vector of Earth's gravity of at least one of the first axis, the second axis, and the third axis.

2. The antenna system of claim 1, wherein the one or more accelerometers include a first two-axis gravity accelerometer mounted on the motion platform assembly and a second gravity accelerometer mounted on the motion platform assembly.

3. The antenna system of claim 2, wherein the second gravity accelerometer is a two-axis gravity accelerometer mounted orthogonally to the first two-axis gravity accelerometer.

4. The antenna system of claim 2, wherein the first two-axis gravity accelerometer and the second gravity accelerometer are accurate to within 1° regardless of the angle of the elevation frame assembly.

5. The antenna system of claim 1, wherein the one or more accelerometers are communicatively connected to the control unit with a non-braided and/or non-shielded wire harness.

6. The antenna system of claim 1, wherein the one or more accelerometers have a maximum error of 1° within an operating temperature range of −40° C. to +125° C.

7. The antenna system of claim 1, wherein:

the control unit is enclosed within the enclosure of the motion platform assembly, and the one or more accelerometers are enclosed within the enclosure.

8. The antenna system of claim 1, wherein the control unit is configured to control at least one of the azimuth driver, the cross-level driver or the elevation driver.

9. The antenna system of claim 8, wherein the control unit is configured to control at least one of the azimuth driver, the cross-level driver or the elevation driver to move the elevation frame to a desired position using the determined location relative to the vector of Earth's gravity of at least one of the first axis, the second axis, and the third axis.

10. A method for determining, the method comprising:

at an antenna system including:

an antenna, a vertical support assembly, a cross-level frame assembly, an elevation frame assembly, a motion platform assembly affixed to and movable with the elevation frame assembly, wherein the motion platform assembly includes, mounted within an enclosure:

a first angular rate sensor configured to sense motion about a first axis, a second angular rate sensor configured to sense motion about a second axis that is orthogonal to the first axis, a third angular rate sensor configured to sense motion about a third axis that is orthogonal to the first axis and the second axis, and one or more accelerometers;

rotating, by an azimuth driver, the vertical support assembly about an azimuth axis;

pivoting, by a cross-level driver, the cross-level frame assembly relative to the vertical support assembly about a cross-level axis;

pivoting, by an elevation driver, an elevation frame assembly relative to the cross-level frame assembly about an elevation axis;

sensing, by the first angular rate sensor, motion about the first axis;

sensing, by the second angular rate sensor, motion about the second axis that is orthogonal to the first axis;

sensing, by the third angular rate sensor, motion about the third axis that is orthogonal to the first axis and the second axis;

sensing, by the one or more accelerometers, a vector of Earth's gravity; and determining, by a control unit that is communicatively connected to the first angular rate sensor, the second angular rate sensor, the third angular rate sensor, and the one or more accelerometers, a location relative to the vector of Earth's gravity of at least one of the first axis, the second axis, and the third axis.

11. The method of claim 10, wherein the control unit is configured to control at least one of the azimuth driver, the cross-level driver or the elevation driver.

12. The method of claim 11, wherein the control unit is configured to control at least one of the azimuth driver, the cross-level driver or the elevation driver to move the elevation frame to a desired position using the determined location relative to the vector of Earth's gravity of at least one of the first axis, the second axis, and the third axis.

* * * * *